US006322230B1

(12) United States Patent
Medici

(10) Patent No.: US 6,322,230 B1
(45) Date of Patent: Nov. 27, 2001

(54) TEMPORARY AND/OR EMERGENCY LIGHTING SYSTEM WITH INFLATABLE BEARING STRUCTURE

(76) Inventor: Guido Medici, Via Fratelli Bandiera, 76, Marghera Venezia 30175 (IT)

( * ) Notice: Subject to any disclaimer, the term of this patent is extended or adjusted under 35 U.S.C. 154(b) by 0 days.

(21) Appl. No.: 09/646,152

(22) PCT Filed: Feb. 16, 1999

(86) PCT No.: PCT/IT99/00033

§ 371 Date: Sep. 14, 2000

§ 102(e) Date: Sep. 14, 2000

(87) PCT Pub. No.: WO99/47853

PCT Pub. Date: Sep. 23, 1999

(30) Foreign Application Priority Data

Mar. 16, 1998 (IT) ..... VE980007 U

(51) Int. Cl.[7] ..... F21V 33/00

(52) U.S. Cl. ..... 362/96; 362/486; 362/542; 362/234; 362/250; 340/321; 340/332

(58) Field of Search ..... 362/96, 486, 253, 362/234, 542, 249, 250, 477, 401; 340/321, 332

(56) References Cited

U.S. PATENT DOCUMENTS 3,592,157 7/1971 Schwartz ..... 340/815.74
5,490,051 * 2/1996 Messana ..... 362/401
6,012,826 * 1/2000 Chabert ..... 362/363

FOREIGN PATENT DOCUMENTS 2645311 4/1978 (DE) .
2314970 1/1977 (FR) .
2736706 1/1997 (FR) .

* cited by examiner

*Primary Examiner*—Thomas M. Sember
*Assistant Examiner*—Ronald E. DelGizzi
(74) *Attorney, Agent, or Firm*—Dowell & Dowell, P.C.

(57) ABSTRACT

The invention is a temporary or emergency lighting system constituted by a bearing structure (2) made of flexible plastic material and having one or more light sources (4) at its top and a support base (1) at its bottom. The structure, which is kept constantly inflated by means of a fan (6), is constituted by one or more superimposed cylinders or cones that are internally divided in sections (2, 1) in order to ensure the progressive and vertical inflation of the structure. The structure can be folded in order to reduce the dimensions of the system as much as possible when it is closed and to make it possible to carry it on the shoulders. The light source is fixed or provided with a rotary mirror (8), in such a way as to direct or rotate the light beam. Some cords or tensioning elements (3) are provided on the structure to limit the height of the bearing structure. The power supply to fans, various functions and/or light source can be guaranteed through a current generator, the power mains or batteries.

17 Claims, 5 Drawing Sheets

Figure 4:
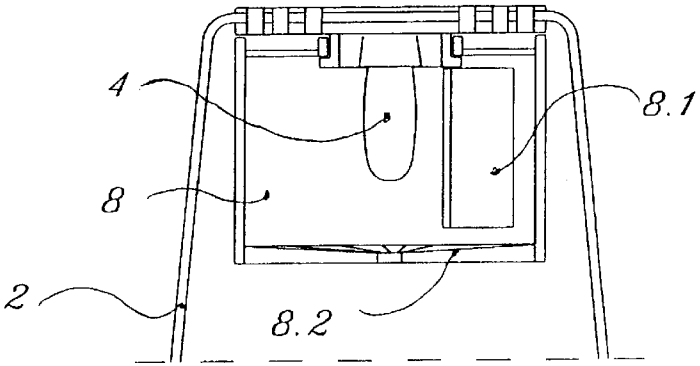

Fig. 6c
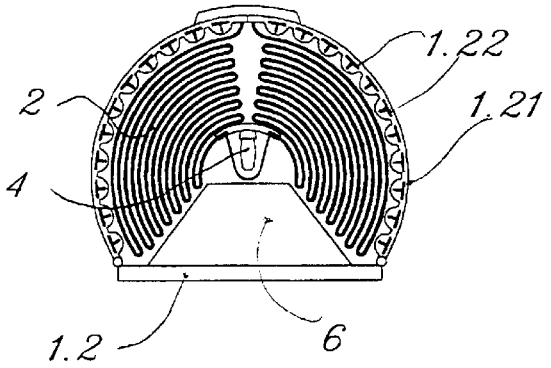
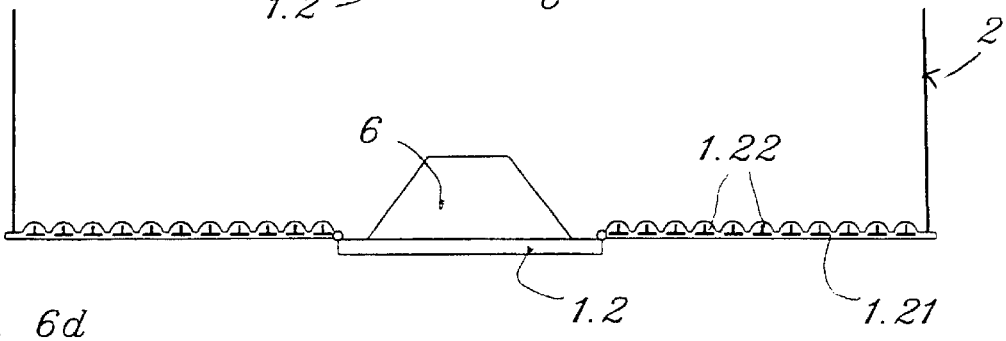
Fig. 6d
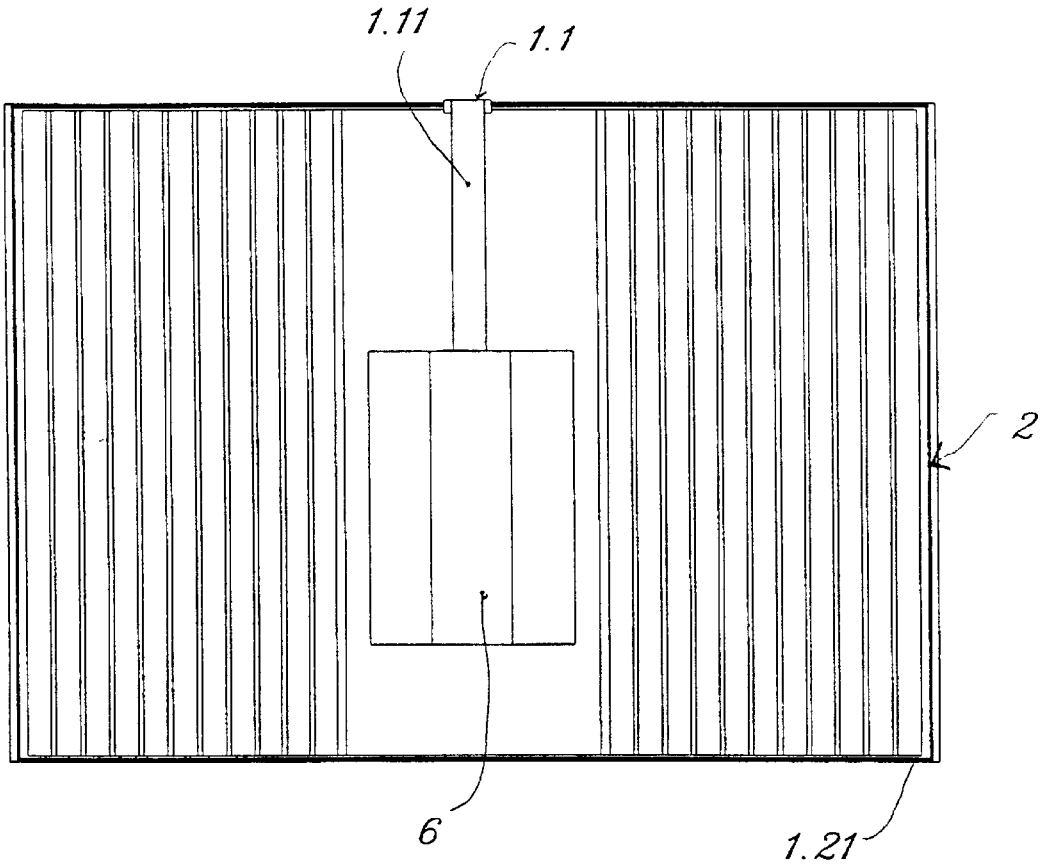
Fig. 6e

TEMPORARY AND/OR EMERGENCY LIGHTING SYSTEM WITH INFLATABLE BEARING STRUCTURE

The present invention concerns the lighting sector and in particular it concerns the temporary and/or emergency lighting of wide outdoor spaces.

Sometimes it is necessary to light wide open spaces even in emergency situations, like blackouts, road accidents, first aid operations, emergency works, natural disasters that occur during the night, when visibility is scarce or there is no visibility at all. In this cases, the operations aimed at supplying or restoring good lighting and visibility conditions take a lot of time, since it is necessary to make use of power units and structures that require the presence of several operators and sophisticated equipment. To illuminate wide spaces, in fact, it is necessary to use powerful light sources that consequently must be positioned at suitable heights, in order to obtain effective lighting and to avoid dazzling the persons that must work in the lit area and limiting their efficiency.

In order to place the light source at suitable height, metal structures ending with a lamp socket are generally used. The transport and installation of these structures require the use of complex and heavy mechanisms, besides transport means that sometimes must be specifically studied for this purpose.

It is also important to consider that the emergency situations occurring at night are difficult to face and further organizational problems may arise if appropriate visibility is not guaranteed immediately.

Practically, every time there is a night emergency, it is also necessary to signal particularly dangerous conditions immediately: closed road, road accident, road block, etc. In these cases the signalling lights used are those installed on the service cars, or otherwise signs positioned on the road surface are used, even if these are not provided with lighting devices. It is therefore important to have a clearly visible light signal, positioned at suitable height and in the colours prescribed by the regulations in force regarding signals.

Finally, if it is necessary to look for persons or objects and visibility is insufficient, electric torches, lamps or similar equipment are generally used. However, these lighting devices present the drawback that the beam they send out is rather limited. In most cases, instead, it is fundamental to have a wide beam, covering all directions, and at the same time a tool that must not be an hindrance for the operator due to its size and weight. Besides unexpected circumstances or dangerous situations in which emergency operations with scarce visibility are required, there is often the need to light up wide spaces for limited lapses of time by means of structures that must be installed and removed very quickly. For example, the use of temporary lighting systems is required for fairs, exhibitions, gardens, etc., both in public and private areas, indoors and outdoors. In these cases overhead lines are used, positioning them on preexisting structures (posts, trees, etc.) or on removable structures constituted by modular systems that in most cases are rather unpleasant to look at. All this requires the presence of specialized personnel and rather long installation and removal times.

In situations like these it would be useful to have a lighting system that does not require the use of said overhead lines: this system should be provided with its own bearing structure, be easy to install even for unskilled personnel and have pleasant aesthetical features in harmony with the environment and the circumstances in which it must be used.

In order to solve all the above mentioned problems, a device has been designed and implemented, which is capable of positioning a light source at considerable height, portable, light and rather small, easy to install and to remove even in critical situations without the use of metal support structures.

The new emergency lighting system comprises, in its main parts, a bearing structure to support the light source, a support base for the bearing structure, a container suitable for housing the base and the bearing structure and for guaranteeing easy transport and an air blowing system for the introduction of air inside the bearing structure.

The bearing structure is preferably constituted by one or more cylinders and/or cones made of fabric or flexible plastic material, ending with a spherical, circular or another shape and whose inside is provided with reflecting surfaces and shape directing and changing systems, said cylinders/cones contain a light source, preferably consisting of a lamp directly positioned inside the cylinder/cone itself, and the bearing structure is provided with elements and devices suitable for inflating it through the constant blowing of pressurized air inside it.

The bearing structure is made of synthetic fabric or heat-sealed plastic material that forms several superimposed cylinders. The material of which the several superimposed cylinders are made is opaque and/or antidazzle, or if necessary coloured, though maintaining suitable transparency, and has original and pleasant aesthetic features.

The various heat-sealed or sewn parts of the bearing structure are watertight thanks to the application of insulating plastic substances or safety heat-seals.

A progressive pressurized air blowing system is provided for the inflation of the structure, in such a way as to ensure its vertical development and the preservation of the acquired shape even in case of wind.

In order to permit the progressive inflation of the bearing structure and its vertical development since the beginning of the air introduction phase, partitions or sections (discs) sealed onto the outer circumference of the bearing structure and provided with holes are positioned inside the structure. The bearing structure is thus divided in different sections corresponding to the each cylinder, whose final circular surfaces for the connection with the other sections are provided with holes. In the bearing structure inflation phase this ensures the creation of a pressure difference between the first section and the successive one. In this way the inflation of the bearing structure is obtained progressively, section after section, together with the vertical development of the structure itself. Said inner sections are made of transparent material, so that the inner diffusion of light is not hindered and the whole bearing structure has the necessary luminosity.

If it is necessary to limit the dispersion of light upwards and to optimize the efficiency of the system, the top of the bearing structure, in correspondence with and around the light source, can be provided with a reflecting surface made of synthetic material.

One or more ducted fans that take air from the outside and convey it inside the structure itself are positioned on the lower end of the bearing structure. The air outlet vents are provided with an unidirectional membrane valve, so that if the fan stops the air contained in the structure will not escape. Furthermore, one or more bleed valves are positioned on the side surface of the bearing structure and near the base and can be operated manually to deflate the structure and fold it.

The bearing structure can be provided with additional coloured surfaces that limit the intensity of the light and permit the use of different colours or the application of signals according to the operator's needs.

The light source is positioned internally at the top of the cylinder constituting the bearing structure.

The light source consists of one or more incandescent, halogen or variable power discharge lamps, at low or high voltage, applied to a suitable support.

The light source is protected, during the operating phase, by a suitable cage guard that insulates it from any accidental contact with the fabric of the bearing structure. If it is not used, it can be manually stored into the appropriate container.

When it is necessary to obtain a "revolving light" effect, the bearing structure can be provided with a rotation system to be positioned on its top, near the light source. This rotation system is obtained either with the rotation of a reflecting surface positioned near the light source or with the rotation of a coloured surface positioned near the source.

The rotation can be obtained either by means of a mechanical device like, for example, an electric motor, or by exploiting the air conveyed by the fans. In the latter case a disc with inclined blades or a similar item can be used: when struck by the air, it makes the device rotate.

If it is necessary to obtain the rotation of the whole bearing structure and not of its upper part only, a movable plate provided with rotation mechanism can be applied to the base.

The power supply to the light source and to the fans is guaranteed by the presence of a self-contained generator, by the connection to the supply mains or by a battery.

The bearing structure support base comprises an anchorage surface and one or more axial or centrifugal fans for the inflation of the structure. It can also be provided with an endothermic motor and an alternator connected to the motor with the function of current generator, with electrical and electronic management and control accessories and with silencing systems.

One of the main features of system object of the invention is represented by its reduced dimensions both when in operation and when the structure is deflated and ready for transport. The cylindrical or conical shape of the bearing structure is the most suitable shape both for the vertical development of the structure itself (so that the light source can be positioned at a considerable height) and for the size requirements.

The operating height of the bearing structure as it has been geometrically defined and its stability and resistance to the bending moments due to the wind are affected both by the inner pressure and by the diameter of the support base. These variables are directly proportional to each other. As a consequence of this, the higher the operating position of the structure is, the greater the inner pressure and the base diameter will be. The need to increase the base diameter creates some size problems, especially for the transport of the system.

Furthermore, the surface of the bearing structure base must necessarily be flat, in order to ensure stable support, and must be characterized by a certain degree of stiffness on at least one of its two axes. In fact, if the surface were flexible on both axes, during the operating phase the effect of the inner pressure would result in the development of a support base with spherical section, with obvious prejudice to the stability of the structure. The problem represented by the need to obtain a wide and rigid base and reduced size at the same time is solved by producing the support base in rigid sections with variable dimensions, in metal or plastic material, connected to one another through airtight hinges. The bearing structure, which develops vertically, is fixed on said base, structured as described above.

When the lamp is not in operation or is being transported, the single sections can be folded on the hinges, thus reducing the size of the structure. During the operating phase the inner pressure of the bearing structure opens the support base.

The advantage offered by this solution is represented by a considerable size reduction and by the fact that the support base can be an element suitable for containing the fabric of the bearing structure when the system is not used. In fact, once they have been folded, the single sections—properly dimensioned and equipped—can serve as walls of the container where the bearing structure and its components can be stored. Coupling systems and properly positioned handles ensure the easy transport of the unit.

Furthermore, for large bases it is possible to provide a support base made of rubber or flexible plastic material, rendered partially rigid on one axis through the application of overturned T bars. This solution makes it possible to wind the base on itself so that it can be used to contain the bearing structure and its components, containing the final shape of a cylindrical container.

The bearing structure is made of fabric or flexible plastic material. In case of considerable vertical development of the structure, the increase in the dimensions of the support base can be sufficient to guarantee the stability of the bearing structure in case of strong wind.

The yielding points of the structure in case of bending moments generated by wind gusts are located near the base. To limit the yield and increase the stiffness of the system with no prejudice to the basic operating principles, for bearing structures with considerable vertical development it is possible to employ fabrics or plastic materials with different weight and thickness: more rigid near the base and gradually lighter and more flexible towards the top.

The anchorage plane of the bearing structure comprises a surface made of metal or another material suitable for the stable fastenining of the bearing structure and for containing it when it is deflated.

The fans generate a continuous air current and maintain sufficient pressure inside the bearing structure, thus making it possible to inflate it and ensuring the necessary stability.

The fan wheels are operated by electric or endothermic motors and can be either axial or centrifugal.

Axial fans are positioned on the anchorage planes and insulated from the planes by means of rubber joints and gaskets that reduce noise, are ducted, operated by electric motors and provided with air conveyors to ensure the necessary aerodynamic characteristics of the system and with noise-reducing devices. Alternatively, the fans and conveyors can be applied onto the lower walls of the bearing structure.

For centrifugal fans, instead, the fan wheel can be connected directly to the current generator rotor or to the shaft of an electric motor or an explosion engine.

The tools and the electric and electronic accessories for the operation, control and management of the system are positioned on the anchorage plane or on the walls of the bearing structure.

The container is a casing suitable for housing the base and the bearing structure and ensures easy transportation of the system. The container also houses the various accessories needed for the assembly and operation of the system, together with the spare parts that may be necessary for this purpose.

The container may be a rigid, box-shaped or similar casing provided with wheels, saddles or other devices that make it possible to move it on roads, grass, ice or snow.

Alternatively, it may even be a flexible casing made of synthetic fabric and provided with all the elements necessary to make it possible to seize it with the hands or to carry it on the shoulders.

The setting at work of this new system is extremely simple and rapid.

It is sufficient to extract the unit from its container and position it on the ground.

The fans constantly convey pressurized air inside the bearing structure, thus inflating it and ensuring the necessary stability stiffness.

As a consequence of this, the inflation of the bearing structure makes it possible to position the light source at the height desired by the operator.

Different lamps of this kind can be connected to one another in order to multiply the size of the area to light up according the need and can be used in case of emergency, but also for the temporary lighting of gardens, fairs, exhibitions, squares.

For this specific purpose the support bases are provided with appropriate inlet and outlet sockets that permit series connection. The system can be connected directly to the power mains or to an external current generator available on the market. It can be used for gardens, conventions, fairs and exhibitions.

The distance of the light source from the ground is given by the length of the bearing structure. However, it may be necessary to have a margin for the operating height.

For this purpose the bearing structure can be equipped with inextensible, sliding cords inserted into appropriate pockets. They are anchored to the side surface of the structure and, on the lower part, to a mechanical return and winding system.

Once the cylinder has been completely inflated, the cord winding mechanism can be operated to reduce the height of the bearing structure and move the light source to the desired height.

The pockets within which the cords are positioned serve as guides and friction elements, so that the curling of the fabric in the return phase takes place in the lower part of the cylinder, without affecting the stability of the bearing structure.

The return system comprises one or more pulleys operated by a geared down electric motor, on which the cords for the lowering of the bearing structure are wound.

Strong lateral winds can affect the stability and verticality of the system and of the bearing structure.

In order to eliminate this inconvenience, the bearing structure is provided with side couplings that in case of wind make it possible to anchor it to the ground by means of cables equipped with tension adjusters that allow the whole bearing structure to be inclined as required.

In addition to this, the differentiated tensioning of the cords anchored to the top permits the deformation of the reflecting surfaces and therefore of the light beam width, while the tensioning of the outer cords anchored to the median points of the support structure makes it possible to direct the light beam laterally.

Since the structure is inflated with air, the geometry of the upper reflecting surface can be altered by positioning an inner cord anchored to the surface centre. When the cord is tensioned, that is, is pulled downwards, the reflecting surface varies and it is possible to control the light cone.

The bearing structure fastening cords make it possible to fasten the system to the ground in case of strong wind and also to incline the bearing structure through the differentiated tensioning of the cords themselves.

The system described above can be implemented in different versions, some of which are illustrated here below.

The base and the fan are positioned inside a rucksack. The cylinder inflates and develops above the rucksack. The air delivery vents are obtained on the rucksack or on the bearing structure with the application of fabric or semirigid plastic material with appropriate inner pipes that convey the air to the fan. The bearing structure and the straps are applied to an aluminum frame on the base of which there is a self-contained generator that powers both the fans and the light source.

This model allows the operator to move easily carrying with himself a light source that can light up a wide space in all directions.

The lighting system described above has the following goals and advantages:

- easy transport: the system can be comfortably transported in the boot of a car;
- independent operation: the system comprises all the elements necessary to make the lamp work;
- ease of use: the lighting system can be set at work by a single operator even if he is not an expert;
- versatility: the lamp can be positioned in extremely small spaces in all weathers;
- positioning of the light source at a considerable height: the system makes it possible to locate the light source in a high position with no need to use rigid structures; furthermore, the light source can be positioned at different heights according to the specific needs;
- diffuse light with possibility to be oriented: this model makes it possible to obtain a diffuse, non-dazzling light that allows the operators to work without hindrances;
- possibility to use it to send out light signals;
- low purchase and operating cost: the model can be produced industrially at low costs.

The following is just one among many possible applications of the invention in question, illustrated in the enclosed drawings.

Figure 1:
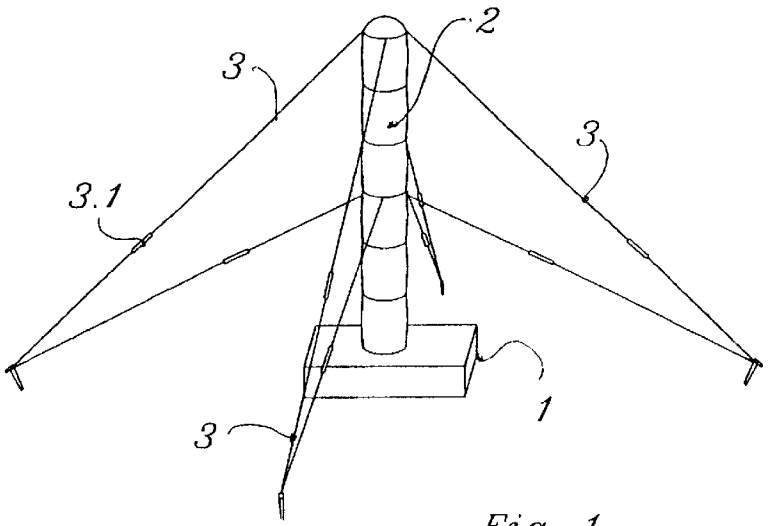

FIG. 1 shows the emergency lighting system when open. It is possible to observe the base with container (1), the inflatable bearing structure (2) and the cables (3) for the anchorage to the ground. It is clearly visible that the bearing structure (2) is divided in several superimposed cylinders.

Figure 2:
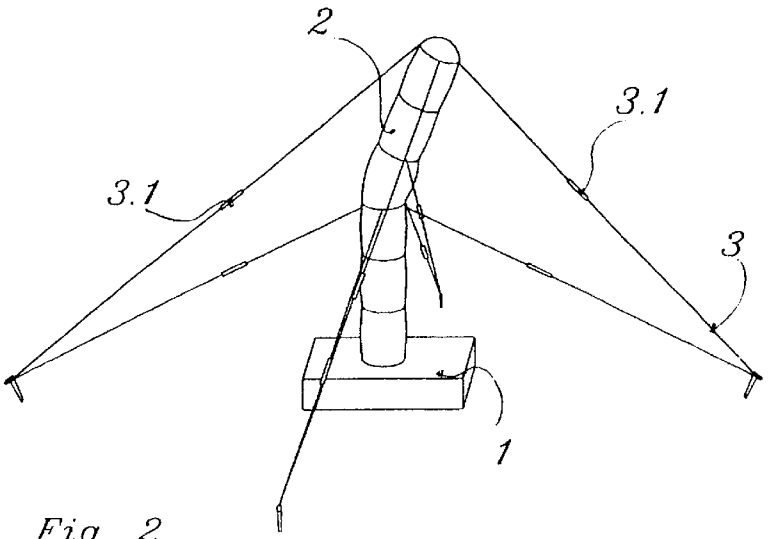

FIG. 2 shows how the fastening cables (3) of the bearing structure (2) make it possible to fix the system to the ground in case of strong wind and also to incline the bearing structure (2) through the differentiated tensioning of the cables (3) themselves.

Figure 3:
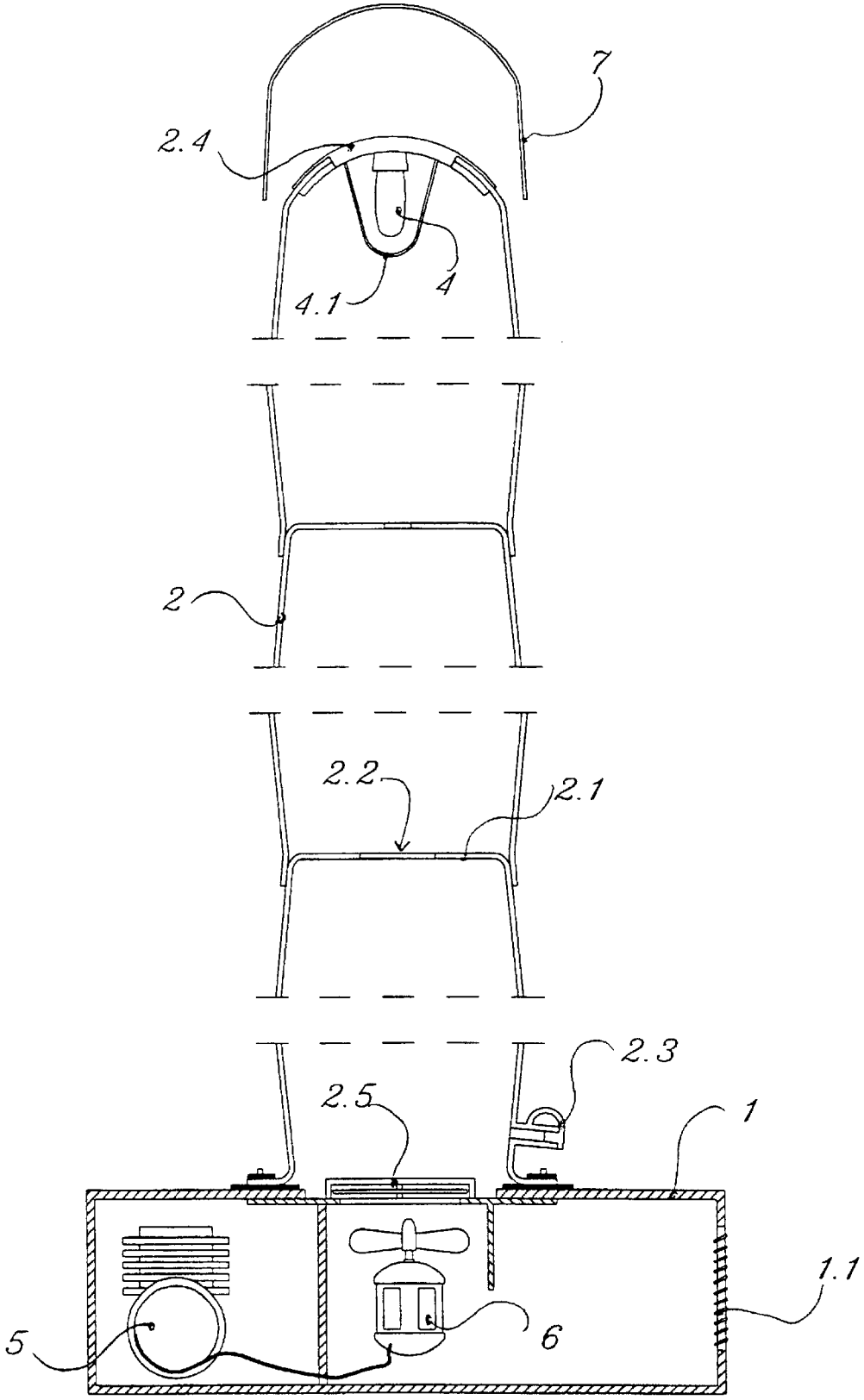

FIG. 3 is a vertical section of the new lighting system, where the various components can be seen. The superimposed cylinders that make up the bearing structure (2) are separated by discs (2.1) sealed to the outer circumference of the bearing structure (2) and provided with holes (2.2). A manual valve (2.3) positioned laterally on the lower part of the bearing structure (2) makes it possible to deflate the bearing structure itself.

The top of the bearing structure (2) is provided with the lamp (4) applied to an opening cover (2.4) and surrounded by a protection element (4.1) that prevents any contact between the lamp (4) and the plastic wall of the bearing structure (2).

The bottom of the bearing structure (2) is connected to the base (1), in which there may be a generator (5) and one or more fans (6) for the blowing of air into the bearing structure (2) through the check valve (2.5) that prevents the deflation of the bearing structure (2) itself in case of malfunction of the fan.

An opening (1.1) in the base (1) ensures the conveyance of air to the fan (6) from the outside.

The same figure shows also a coloured cover (7), with any type of lamp—even a stroboscopic lamp—applied to the top of the bearing structure (2).

FIG. 4 shows how to obtain a "revolving light" effect, that is, a rotating light beam: a cylindrical covering element (8) provided with a slit (8.1) on its side surface is hinged to the support of the lamp (4) and is provided with inclined fins (8.2) in its lower part.

The air introduced by the fan (6) reaches the top of the bearing structure (2), acts on the inclined fins (8.2) of the cylindrical covering element (8), thus making it rotate, and is discharged through apposite holes (2.5) present on the top of the bearing structure (2).

The cylindrical covering element (8) rotates and allows the lamp (4) to project light only towards the slit (8.1) on the covering element (8) itself, whose position can obviously change.

Figure 5:
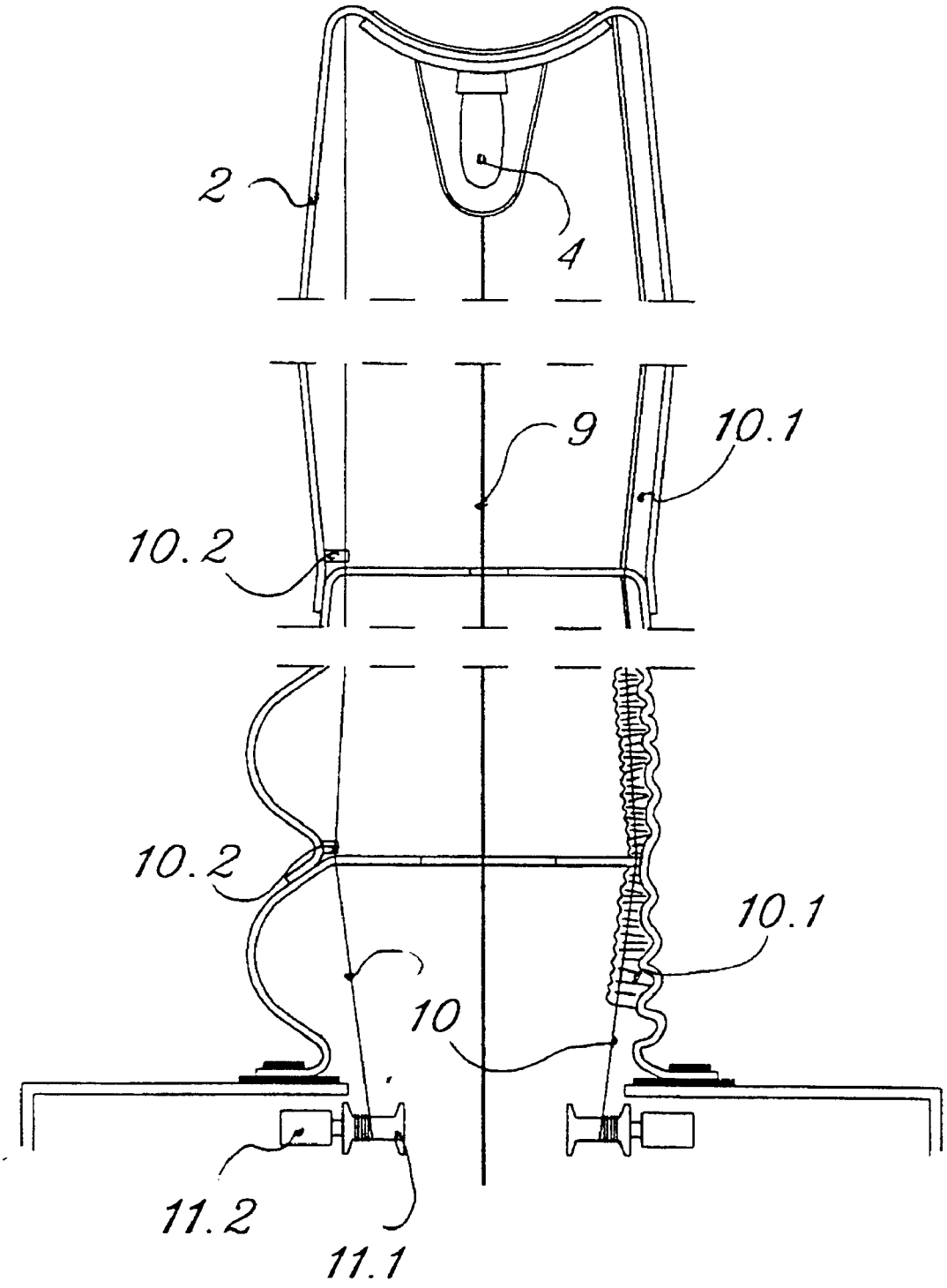

FIG. 5 shows both the central cord (9) positioned inside the bearing structure (2) and the inner lateral cords (10) for the adjustment of the bearing structure height.

The central cord (9) makes it possible to bend the top of the bearing structure (2) downwards, in such a way as to modify the geometry of the projection of the light beam sent out by the lamp (4).

The inner lateral cords (10) are housed in slots (10.2) or pockets (10.1) provided inside the bearing structure (2). Apposite mechanisms with one or more pulleys (11.1) operated by an electric motor (11.2), on which the cords (10) for the lowering of the bearing structure (2) are wound, are also provided.

Figure 6B:
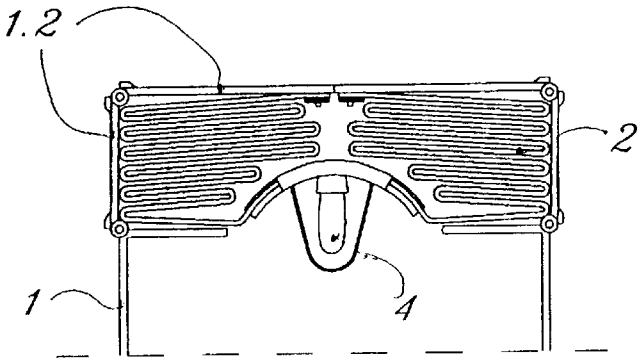
Figure 6A:
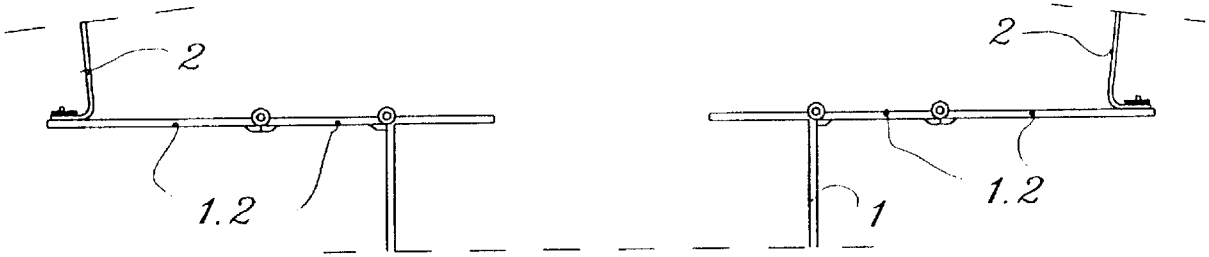

FIGS. 6*a* and 6*b* show how the base (1) can be opened, with the various folding walls (1.2) constituting a wider support base for the bearing structure (2) (FIG. 6*a*), and how it can be closed, with the folding walls (1.2) of the base (1) enclosing the deflated structure (2) and the lamp (4).

FIGS. 6*c*, 6*d* and 6*e* are three different views of a further application of the invention: a closed vertical section, an open vertical section and an open horizontal section. In the last case a rigid plane base (1.2) houses the fans (6) and is provided, at its edges, with two flexible walls (1.21) with rigid linear elements (1.22); said walls fold and enclose the deflated bearing structure (2) and the lamp (4). In the open operating position the two flexible walls (1.21) spread out at the sides of the rigid plane base (1.2) and permit the inflation of the bearing structure (2). In this example the fan unit (6) is enclosed in the bearing structure (2) and a flexible duct (1.11) connects the fan unit (6) to the external air intake (1.1) positioned on the base perimeter of the bearing structure (2).

Figure 7:
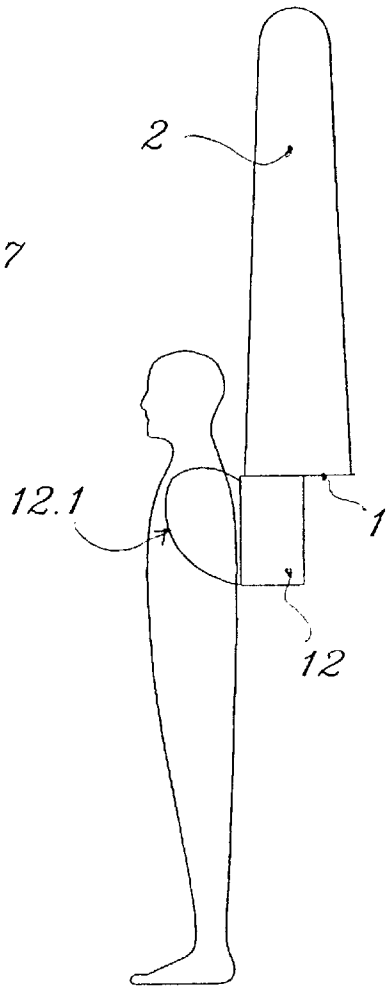

FIG. 7 shows a version of the system object of the invention that can be carried on the shoulders. In this case the container (12) and the base (1) are provided with straps (12.1) and the bearing structure (2) develops above the person who carries the unit.

The above are the basic outlines of the invention, on the basis of which the technician will be able to put it into effect; any change which may be necessary upon implementation is to be regarded as completely protected by the present invention, provided that it is based on the same innovative concept described herein.

Therefore, with reference to the above description and to the attached drawings, the following claims are put forth.

What is claimed is:

1. Temporary or emergency lighting system, comprising an inflatable bearing structure made of fabric or flexible plastic material, provided at its top with one or more light sources and at its bottom with a support base, and also provided with at least one fan to constantly convey air inside said structure and maintain sufficient pressure to guarantee the stability and stiffness of the structure itself, characterized in that said bearing structure is constituted by one or more superimposed cylinders or cones, internally divided in sections through the positioning of partitions or discs provided with holes that ensure the progressive and vertical inflation of the structure, and wherein, in the lower part, in correspondence with the air inlet vents, a check valve is provided in order to prevent the structure from rapidly deflating in case of malfunction of the fan.

2. Temporary or emergency lighting system according to claim 1, characterized in that it is provided with a valve that is positioned on the structure surface and can be activated by the operator to permit the quick deflation of the structure itself.

3. Temporary or emergency lighting system according to claim 1, characterized in that its base is provided with an inlet socket for the power supply and an outlet socket for the series connection of more than one system.

4. Temporary or emergency lighting system according to claim 1, characterized in that its support base is a circular or square plane surface made of plastic or metal and divided in sections that are joined through hinges, connections or airtight elastic systems, so that said sections can be folded in order to reduce the size of the closed system as much as possible and ensure easy transport, and wherein the sections of the base itself constitute elements for the connection of the structure to its components.

5. Temporary or emergency lighting system according to claim 1, characterized in that its plane and rigid support base is provided at its sides with flexible walls with linear stiffening elements, and wherein the bearing structure is fixed with airtight effect both to the support base and to its flexible walls, and wherein said flexible walls, when folded, enclose the bearing structure, the lamp, the fan unit and the other accessories, and wherein said flexible walls, when open, serve as an extension of the support base for the stabilization of the lighting system.

6. Temporary or emergency lighting system according to claim 1, characterized in that the wheel of the centrifugal fan, if any, is connected to the extension of the alternator shaft.

7. Temporary or emergency lighting system according to claim 1, characterized in that the light source is positioned inside the bearing structure made of fabric or plastic material, and wherein the whole bearing structure or at least its upper end is transparent or semi-transparent.

8. Temporary or emergency lighting system according to claim 1, characterized in that the light source is positioned outside the bearing structure made of fabric or plastic material.

9. Temporary or emergency lighting system according to claim 1, characterized in that the light source is provided with a screen or mirror that rotate on the vertical axis in such a way as to direct or constantly rotate the light beam.

10. Temporary or emergency lighting system according to claim 1, characterized in that it is provided with tension wires or cords housed in the bearing structure into apposite pockets, fixed to the wall of the bearing structure and in the lower part wound on motor-driven pulleys, and wherein the total or partial unwinding of said tension wires or cords determines the height of the bearing structure.

11. Temporary or emergency lighting system according to claim 1, characterized in that it is provided with tension wires or cords that are fixed to the sides of the bearing structure and can be anchored to the ground to stabilize the lighting system.

12. Temporary or emergency lighting system according to claim 1, characterized in that the inner part of the top of the bearing structure is made of reflecting material, and wherein an inner central cord lowers the central part of the structure top and modifies its geometry.

13. Temporary or emergency lighting system according to claim 1, characterized in that its base is equipped with an endothermic motor coupled to an alternator, in such a way as to constitute a current generator for the fans, the various functions and/or the light source and to make the system completely self-contained.

14. Temporary or emergency lighting system according to claim 1, characterized in that its base is provided with a battery to supply power to the light source, the various functions and/or the fans.

15. Temporary or emergency lighting system according to claim 1, characterized in that it is connected to the power mains in order to supply power to the light source, the various functions and/or the fans.

16. Temporary or emergency lighting system according to claim 1, characterized in that it is provided with a container suitable for housing the whole system, constituted by a rigid box-shaped or similar casing, provided with straps, so that it can be carried on the shoulders, or with wheels and/or saddles or other devices that make it possible to move it easily on roads, any type of ground, ice and snow.

17. Temporary or emergency lighting system according to claim 1, characterized in that its base is provided with straps, so that it can be carried on the shoulders both when it is folded and when it must be used as a movable lighting and/or signalling system transported by a person.

* * * * *